US007055978B2

(12) United States Patent
Worthington

(10) Patent No.: US 7,055,978 B2
(45) Date of Patent: Jun. 6, 2006

(54) APPARATUS AND METHOD FOR LIGHTING WEARABLE ITEMS

(75) Inventor: Amanda Marie Worthington, Eagan, MN (US)

(73) Assignee: W Z Enterprises, Inc., Eagan, MN (US)

( * ) Notice: Subject to any disclaimer, the term of this patent is extended or adjusted under 35 U.S.C. 154(b) by 28 days.

(21) Appl. No.: 10/621,660

(22) Filed: Jul. 17, 2003

(65) Prior Publication Data

US 2005/0013128 A1 Jan. 20, 2005

(51) Int. Cl.
*A45C 15/06* (2006.01)
*F21V 9/16* (2006.01)

(52) U.S. Cl. ..... 362/103; 362/84; 362/156

(58) Field of Classification Search ..... 362/84, 362/108, 156, 103, 806, 154, 570, 571, 106, 362/104; 36/137; 2/102, 906; 150/106, 150/100

See application file for complete search history.

(56) References Cited

U.S. PATENT DOCUMENTS 5,475,574 A * 12/1995 Chien ..... 362/108
5,836,671 A * 11/1998 Chien ..... 362/84
5,869,930 A * 2/1999 Baumberg et al. ..... 313/506
5,871,269 A * 2/1999 Chien ..... 362/84
5,934,790 A * 8/1999 Quintana et al. ..... 362/156
6,116,745 A * 9/2000 Yei ..... 362/106
6,340,235 B1 * 1/2002 Bryan ..... 362/156

* cited by examiner

*Primary Examiner*—Ali Alavi
*Assistant Examiner*—Bao Q. Truong
(74) *Attorney, Agent, or Firm*—Gary L. Huusko

(57) ABSTRACT

A wearable item, such as a backpack, waistpack or other like carry-type bag or an article of clothing such as a jacket that has attached to it a flexible electroluminescent wire, capable of emitting steady or intermittent light, and further capable of emitting a multiplicity of colors, thereby making the backpack, waistpack or other like bag or article of clothing visible, and thus the wearer will be more visible and safe. The flexibility of the electroluminescent wire allows it to be attached to the backpack and clothing in a variety of ways and shapes, thereby making the backpack and clothing more visible and safe, as well as more attractive and unique.

24 Claims, 4 Drawing Sheets

APPARATUS AND METHOD FOR LIGHTING WEARABLE ITEMS

BACKGROUND OF INVENTION

1. Field of Invention

This invention relates to an apparatus and method for lighting wearable items, such as jackets and other clothing items and bags that are carried or worn by use of a strap or belt, or multiple straps or belts, such as a purse, or a backpack worn on one's back with the use of a shoulder strap or multiplicity of shoulder straps, or a fanny pack worn around one's waist with the use of a belt, and in particular to clothing and a bag such as that described above that includes a flexible electroluminescent light filament component with a greatly increased electrical capacity, a substantially increased brightness and a greater flexibility.

2. Discussion of Prior Art

The prior art is exemplified by many examples of clothing items, backpacks, fanny packs, and other "carryable" luggage articles that include some type of lighting source, and are well-known and in widespread use.

While lighted clothing and backpacks have been proposed, using incandescent light sources, light emitting diodes (LEDs) and electro-luminescent (EL) light strips and panels, there are found many disadvantages inherent in those applications. The disadvantages of those include excessive weight, size and power consumption of the incandescent light sources, narrow viewing angle of the light and insufficient visibility of the light of the LEDs, and reduced electrical capacity of the light source, reduced brightness, fragility and reduced flexibility, and optical discontinuity in the EL layer, causing further substantial light losses of the EL strips and panels. The known prior art, as shown in U.S. Pat. No. 5,836,671, limits the lighting source to the electroluminescent light strip in the form of a multi-element light panel of the type described in U.S. Pat. No. 5,572,817. The disadvantages of a luminescent light strip include reduced flexibility, that is, the light strip is more fragile and will not withstand multiple flexing or bending, which would occur quite frequently when placed on a jacket or other item of clothing or on a child's backpack, and optical discontinuity in the EL layer, causing further, substantial light losses.

A further disadvantage of the prior art relates to the failure to have a time-out switch, thus allowing the light source to automatically turn itself off, thereby preserving the life of the light source and power source.

SUMMARY OF THE INVENTION

It is thus an objective of the present invention to overcome the drawbacks of the prior art and to provide a lighted article of clothing, backpack, waist pack and other carry-type bag with increased brightness of the light source, increased electrical capacity of the electroluminescent filament, increased versatility of the lighting placement, increased flexibility in the lighting placement, increased safety and visibility of the wearer, and increased attractiveness of the pack.

According to the invention, this objective is achieved by providing a backpack or other carry-type bag or article of clothing in which the lighting source consists of at least one flexible, cable-like electroluminescent wire, such as that marketed by ELAM, Electroluminescent Industries, Ltd. as LyTec TM. and as described in U.S. Pat. No. 5,869,930, more specifically, a light source consisting of at least one flexible, cable-like electroluminescent filament, each filament comprising a central electrode surrounded by an electrically insulating dielectric layer; a layer consisting of a mixture of an electroluminophor powder and a binder, said mixture being applied to said dielectric layer; a transparent electrode surrounding the layer consisting of said mixture, wherein pores formed in said mixture layer are filled in by a transparent filler substance.

This objective is further achieved by providing the backpack or other carry-type bag with a compact and lightweight power source and control device. The power source can be DC with a DC/AC converter and transformer unit, with rechargeable batteries, and the control device can include certain special effects, such as a continuous light, flashing, strobe or a blinking light, and a time-out switch.

DETAILED DESCRIPTION OF THE DRAWINGS AND DESCRIPTION OF THE PREFERRED EMBODIMENT

Figure 1:
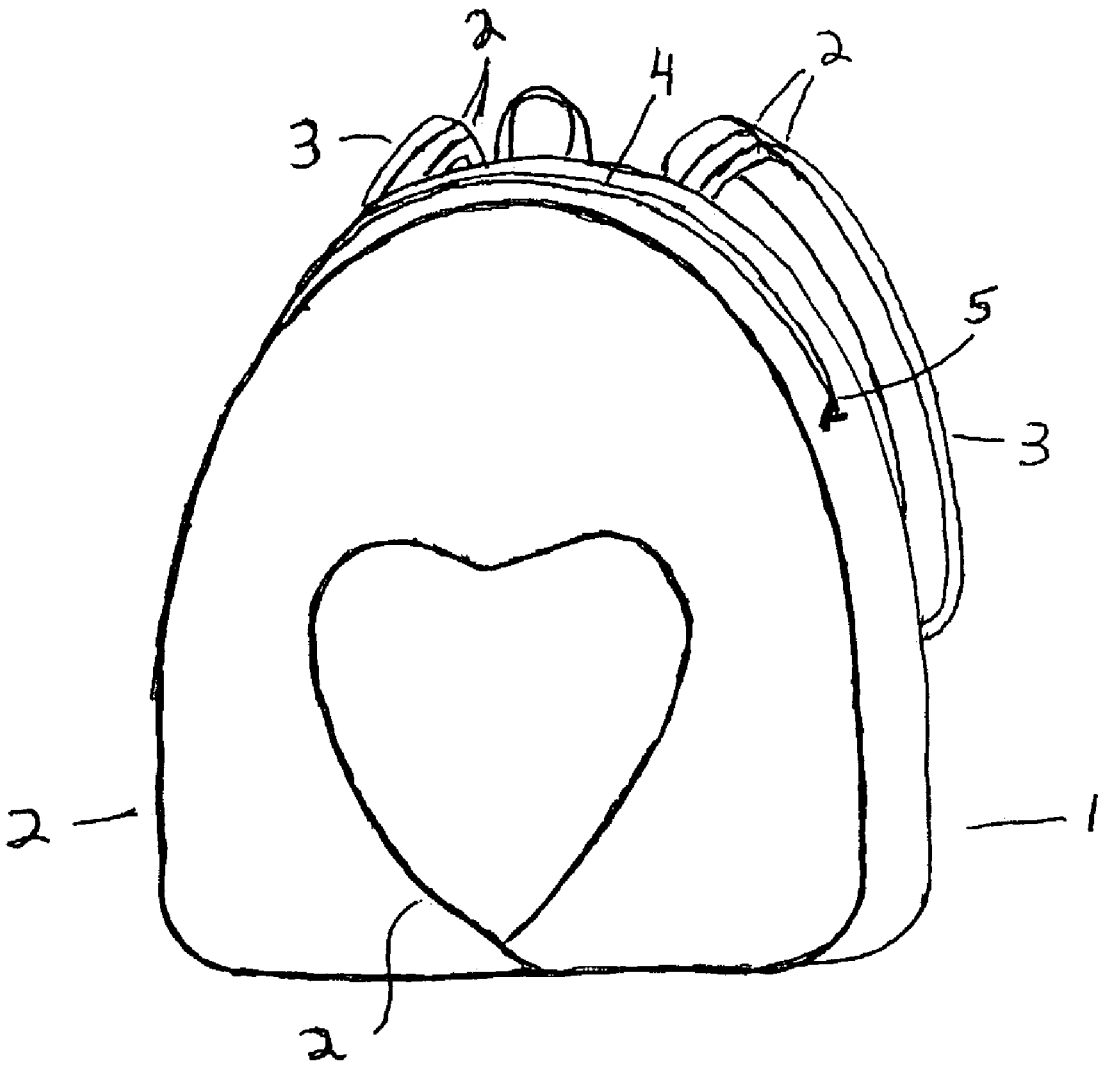
FIG. 1 is a perspective view of the preferred embodiment in which the carry-type bag is a backpack.

FIG. 1 shows a backpack in accordance, with the preferred embodiment, that of a flexible electroluminescent wire 2 ("EL wire") attached thereto. The EL wire 2 can be attached through a variety of attaching means, such as glue, tape, cloth or non-abrasive staples, or the like, and the EL wire 2 can also be attached by means of sewing the EL wire 2 onto the outer portion of the backpack, or in or along a seam of the backpack, thereby making the backpack more attractive. The EL wire can, therefore, be incorporated into the manufacture of the backpack by being sewn into the seams, thus outlining the backpack's silhouette and other features. The flexibility of the EL wire 2 allows it to also be attached in a variety of designs, including shapes, letters, words, or numbers, being limited only by one's imagination, thereby making the backpack more attractive and unique.

Referring still to FIG. 1, the backpack 1 includes a plurality of straps 3 designed to be worn over the shoulders of the wearer, a bag or case made of a relatively soft, lightweight material, such as plastic, nylon, natural or synthetic cloth or cloth-like material, or leather, which includes a compartment for carrying a load, an open top 4, and a closing means 5 attached to said open top 4, said closing means could be a variety of closures, such as a zipper, tying cord, flap and buckle, or the like. The backpack further includes a control driver 6 and a power source 9 which are attached to the flexible electroluminescent wire 2, thus providing the means for the EL wire 2 to glow.

Figure 2:
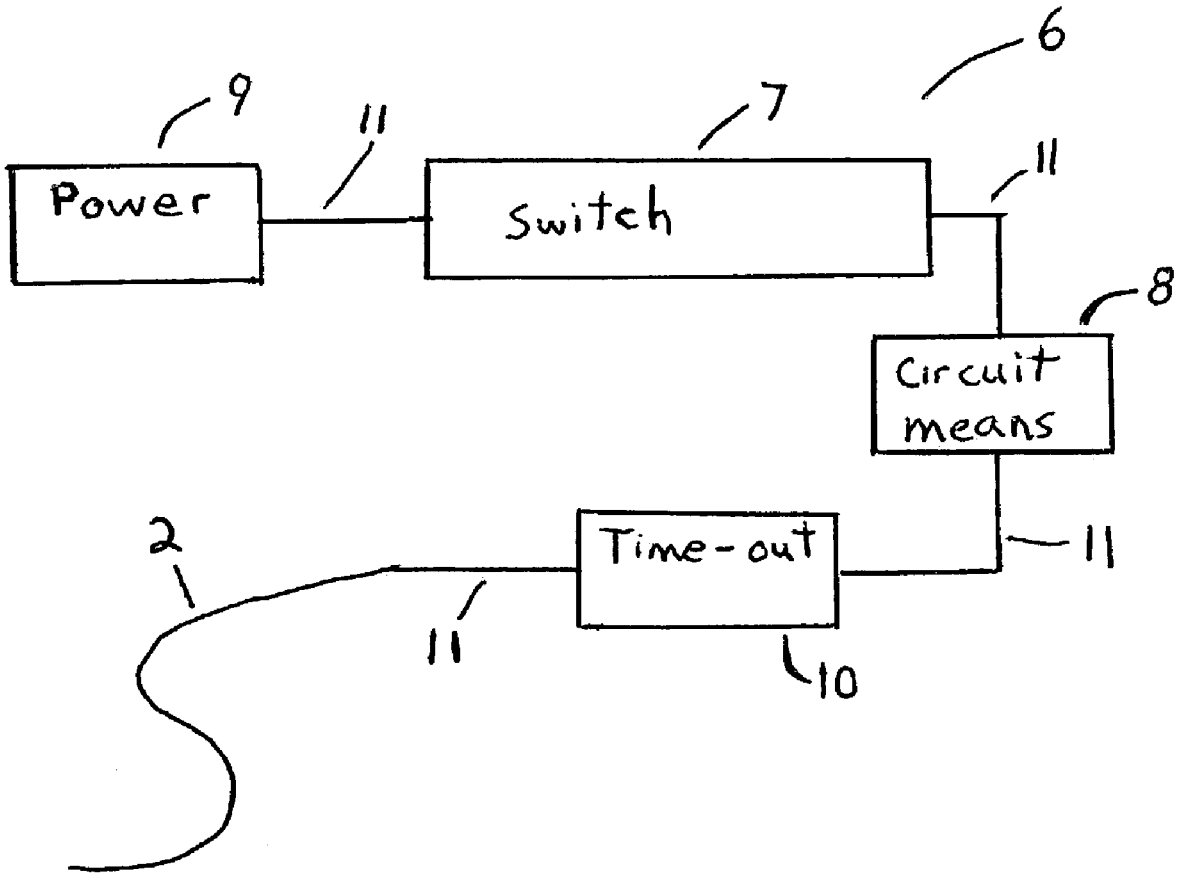
FIG. 2 is a functional block diagram of a circuit for powering the electroluminescent filament of the preferred embodiment.

Referring now to FIG. 2, the control driver 6 comprises a switch 7, a circuit means 8, a time-out switch 10 and connecting wire 11 connecting said control driver 6, switch 7, circuit means 8, power source 9, time-out switch 10 and EL wire 2 together. The preferred embodiment of the power source 9 is a DC power supply, such as dry cell batteries, either rechargeable or not, to which a DC/AC converter and or transformer could be attached. With rechargeable batteries, a rechargeable power outlet 12 would be disclosed and incorporated into the invention attached to the power source 9, thus enabling the power source 9 to be recharged without being taken out of the backpack. Within the circuit means 8 would be the capability to provide for either a constant emission of light or intermittent emission of light, such as blinking at varied intervals.

Figure 3:
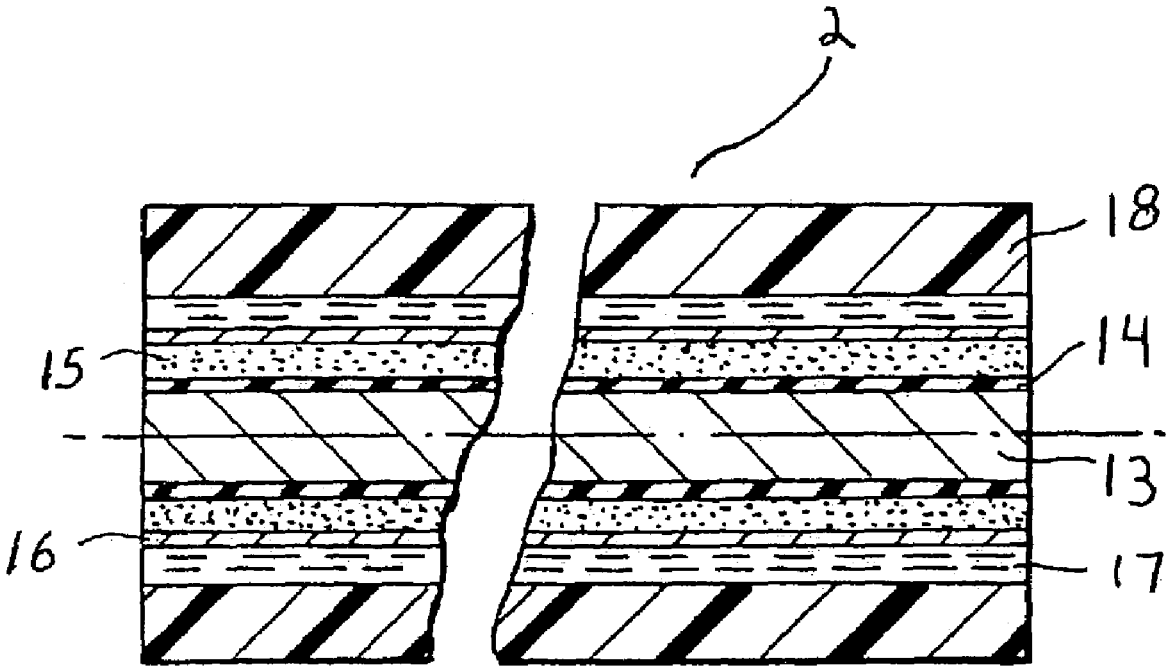
FIG. 3 is a longitudinal cross-section that illustrates the detailed structure of the electroluminescent layer.

Referring now to FIG. 3, a representative EL wire 2 is shown in a longitudinal cross-sectional view. FIG. 3 shows the detailed structure of such an EL wire having a flexible copper wire serving as an electrode 13 and covered by an electrically insulating dielectric layer 14. Layer 14 is surrounded by an electroluminophor layer 15. Layer 15 is surrounded by a thin, transparent electrode 16, such as gold or conductive oxides or conductive polymers. Layer 15 is covered by a barrier layer 17 consisting of a transparent viscous substance. Layer 17 is surrounded by a transparent, flexible polymer 18. As indicated earlier, this representative flexible EL wire is merely one of the types of flexible EL wire that can be used. There exist several different types, and all will allow for the flexibility of attachment to the backpack, thus allowing for more flexibility in shape and design on the backpack and will be more adaptable to a variety of means of attachment to the backpack. The preferred embodiment of the flexible EL wire is one such that emits a variety of colors, depending upon the make-up of the particular flexible EL wire.

Figure 4:
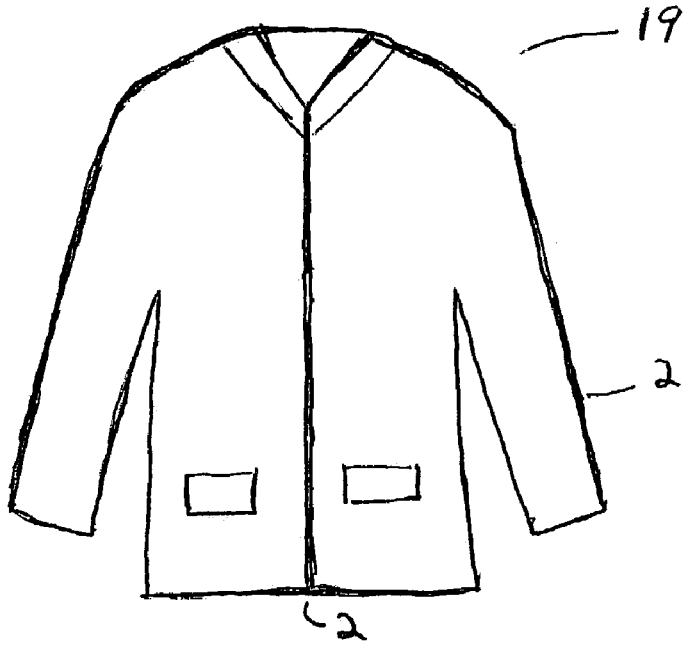
FIG. 4 is a perspective view of the preferred embodiment in which the EL wire is attached to a jacket.
Figure 4A:
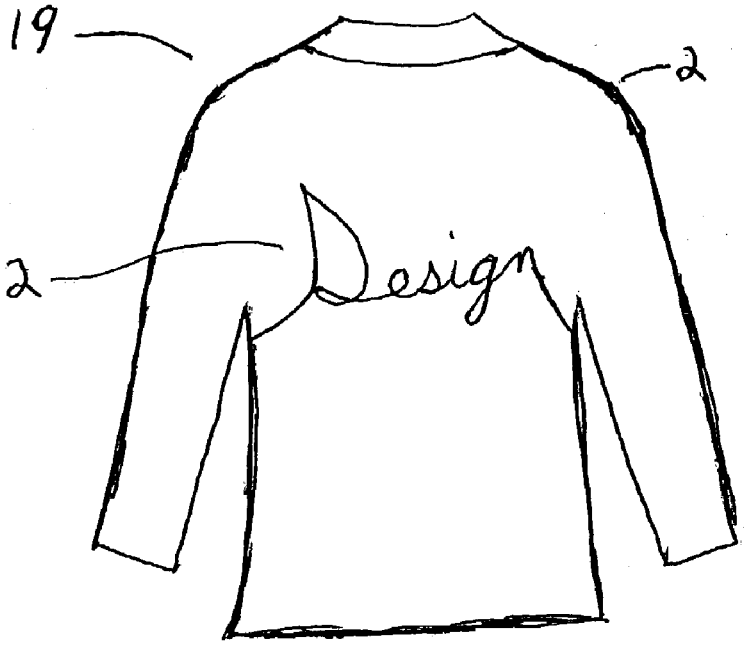

Referring now to FIGS. 4 and 4A, these show a jacket 19, front and back, in accordance with another preferred embodiment, that of a flexible electroluminescent wire 2 ("EL wire") attached thereto. The EL wire 2 can be attached through a variety of attaching means, such as glue, tape, cloth or non-abrasive staples, or the like, and the EL wire 2 can also be attached by means of sewing the EL wire 2 onto the jacket, or in or along a seam of the jacket, thereby making the jacket more attractive. The EL wire can, therefore, be incorporated into the manufacture of the jacket by being sewn into the seams, thus outlining the jacket's silhouette and other features. The EL wire 2 can also be attached in a variety of designs, including shapes, letters, words, or numbers, being limited only by one's imagination, thereby making the jacket more attractive and unique.

In operation, the direct current supplied by DC power source 9 is thus converted into an alternating current of a desired frequency by DC/AC converter to the transformer for increasing the voltage of the alternating current, and then transmitted from the transformer to the circuit means 8. Circuit means 8 provides a number of preset or switchable options for turning on the EL wire 2, e.g., steady, flash, sequential or random, and may take any desired form from a simple flasher circuit to a microprocessor, depending on the complexity of the special effects to be exhibited. Also, while the EL wire 2 can be turned on and off by means of a switch 7, it may also be desired to include or substitute a photosensitive, vibration-sensitive, tilt-sensitive, or motion-sensitive switch to automatically turn the light on and off upon the occurrence of external events such as nightfall or various movements by the wearer. After, a set period of time, the current may be terminated by the operation of the time-out switch 10, thereby conserving both the power source 9 and the life of the EL wire 2.

Further, the power source 9 can comprise rechargeable batteries, in which case, a rechargeable power outlet 12 could be incorporated into the backpack, thereby allowing for the unit to be plugged into a wall outlet, and thereby recharging the batteries.

Having thus described specific preferred embodiments of the invention in terms which will enable those skilled in the art to make and use the invention, it will nevertheless be appreciated that numerous variations and modifications are possible within the scope of the invention. Thus, it is intended that the invention not be limited by the above description or drawings, but rather that it be limited solely by the appended claims.

I claim:

1. An apparatus for lighting a wearable item, comprising: a lighting arrangement made up of a flexible cable-like electroluminescent wire, a flexible cable-like electroluminescent wire attaching means, a power source, a control driver, and a connecting wire, said flexible cable-like electroluminescent wire having an electrode covered by an electrically insulating dielectric layer, said dielectric layer being surrounded by an electroluminophor layer, said electroluminophor layer being surrounded by a thin transparent electrode, said thin transparent electrode being covered by a barrier layer consisting of a transparent viscous substance, and said barrier layer being surrounded by a transparent flexible polymer, said control driver having a switch to turn the flexible cable-like electroluminescent wire on and off, and a circuit means, said connecting wire connecting the control driver and power source to the flexible cable-like electroluminescent wire, thereby allowing for electrical current from the power source to reach the flexible cable-like electroluminescent wire, said lighting arrangement being attached to the item, said item having an outer portion and a plurality of seams, wherein the flexible cable-like electroluminescent wire is attached to the outer portion of the item with the flexible cable-like electroluminescent wire attaching means.

2. The apparatus of claim 1, wherein the circuit means further comprises a function interface including means for causing the flexible cable-like electroluminescent wire to switch on and off intermittently in a random or a predetermined pattern.

3. The apparatus of claim 2, wherein the control driver further comprises a time-out switch, wherein the current is terminated after a set period of time by the operation of the time-out switch, thereby conserving both the power source and the life of the flexible cable-like electroluminescent wire.

4. The apparatus of claim 3, wherein the flexible cable-like electroluminescent wire attaching means is selected from the group consisting of glue, cloth or non-abrasive staples, and stitching.

5. The apparatus of claim 4, wherein the power source is a DC power supply, and the circuit means includes means for converting DC current supplied by the power supply to an AC current and supplying the AC current to the flexible cable-like electroluminescent wire.

6. The apparatus of claim 4, wherein the power source is a dry cell battery.

7. The apparatus of claim 4, wherein the power source is a rechargeable battery.

8. The apparatus of claim 4, wherein the flexible cable-like electroluminescent wire is attached to the item along the item's seams.

9. The apparatus of claim 4, wherein the item is a backpack.

10. The apparatus of claim 4, wherein the item is a waist pack.

11. The apparatus of claim 4, wherein the item is an article of clothing.

12. The apparatus of claim 11, wherein in the article of clothing is a jacket.

13. A method for lighting a wearable item, comprising; a lighting arrangement made up of a flexible cable-like electroluminescent wire, a flexible cable-like electroluminescent wire attaching means, a power source, a control driver, and a connecting wire, said flexible cable-like electroluminescent wire having an electrode covered by an electrically insulating dielectric layer, said dielectric layer being surrounded by an electroluminophor layer, said electroluminophor layer being surrounded by a thin transparent electrode, said thin transparent electrode being covered by a barrier layer consisting of a transparent viscous substance, and said barrier layer being surrounded by a transparent flexible polymer, said control driver having a switch to turn the flexible cable-like electroluminescent wire on and off, and a circuit means; said connecting wire connecting the control driver and power source to the flexible cable-like electroluminescent wire, thereby allowing for electrical current from the power source to reach the flexible cable-like electroluminescent wire, said lighting arrangement being attached to the item, said item having an outer portion and a plurality of seams, wherein the flexible cable-like electroluminescent wire is attached to the outer portion of the item with the flexible cable-like electroluminescent wire attaching means.

14. The method of claim 13, wherein the circuit means further comprises a function interface including means for causing the flexible cable-like electroluminescent wire to switch on and off intermittently in a random or a predetermined pattern.

15. The method of claim 14, wherein the control driver further comprises a time-out switch, wherein the current is terminated after a set period of time by the operation of the time-out switch, thereby conserving both the power source and the life of the flexible cable-like electroluminescent wire.

16. The method of claim 15; wherein the flexible cable-like electroluminescent wire attaching means is selected from the group consisting of glue, cloth or non-abrasive staples, and stitching.

17. The method of claim 16, wherein the power source is a DC power supply, and the circuit means includes means for converting DC current supplied by the power supply to an AC current and supplying the AC current to the flexible cable-like electroluminescent wire.

18. The method of claim 16, wherein the power source is a dry cell battery.

19. The method of claim 16, wherein the power source is a rechargeable battery.

20. The method of claim 16, wherein the flexible cable-like electroluminescent wire is attached to the item along the item's seams.

21. The method of claim 16, wherein the item is a backpack.

22. The method of claim 16, wherein the item is a waist pack.

23. The method of claim 16, wherein the item is an article of clothing.

24. The method of claim 23, wherein in the article of clothing is a jacket.

* * * * *